US005905343A

United States Patent [19]

McCamant

[11] Patent Number: 5,905,343

[45] Date of Patent: May 18, 1999

[54] INDUCTIVELY COUPLED INCANDESCENT LIGHT BULB

[76] Inventor: Angus J. McCamant, 1010 SW. 193rd Ct., Aloha, Oreg. 97006

[21] Appl. No.: 08/541,501

[22] Filed: Oct. 10, 1995

[51] Int. Cl.[6] ..... H01K 13/06

[52] U.S. Cl. ..... 315/57; 315/62; 313/160

[58] Field of Search ..... 315/57, 62, 248, 315/267, 344; 313/156–158, 160, 161, 113, 485

[56] References Cited

U.S. PATENT DOCUMENTS

| | | | |
|---|---|---|---|
| 3,048,738 | 8/1962 | Paul, Jr. | 315/248 X |
| 3,420,944 | 1/1969 | Holcomb | 174/17.5 |
| 3,431,448 | 3/1969 | English | 313/37 |
| 3,500,118 | 3/1970 | Anderson | 315/248 X |
| 3,605,364 | 9/1971 | Ford | 313/161 X |
| 3,789,255 | 1/1974 | Sell et al. | 313/217 |
| 3,987,335 | 10/1976 | Anderson | 315/62 |
| 4,180,763 | 12/1979 | Anderson | 315/344 X |
| 4,187,446 | 2/1980 | Gross et al. | 315/58 |
| 4,311,942 | 1/1982 | Skeist et al. | 315/62 |
| 4,451,760 | 5/1984 | Griffen et al. | 313/557 |
| 4,499,398 | 2/1985 | Mundroe | 313/113 |
| 4,568,854 | 2/1986 | Westllund, Jr. et al. | 313/579 |
| 4,692,661 | 9/1987 | Moskowitz et al. | 313/161 X |
| 4,855,635 | 8/1989 | Grossman et al. | 313/156 |
| 5,359,262 | 10/1994 | Bell et al. | 313/579 |

FOREIGN PATENT DOCUMENTS

| | | | |
|---|---|---|---|
| 4380 | 1/1978 | Japan | 315/248 |
| 172858 | 10/1983 | Japan | 315/344 |

*Primary Examiner*—Benny Lee
*Attorney, Agent, or Firm*—William S. Lovell

[57] ABSTRACT

An incandescent bulb having a looped filament within an evacuated bulb containing a gas mixture including a halogen employs magnetic means external to the bulb to provide inductive heating of the filament so that there are no connections passing through the bulb envelope. Alternative embodiments include a toroidal bulb wherein a second arm of a magnetic circuit passes normally through the center of the bulb toroid, alternating voltage excitation being supplied to a first arm of the magnetic circuit; and an elliptical bulb that is disposed between oppositely facing ends of a two-part second magnetic arm that is similarly excited. In a further embodiment, an additional arm of the magnetic circuit serves to form a non-uniform field in the vicinity of the filament, thereby to provide a lift force against the force of gravity so as to minimize filament sagging.

14 Claims, 3 Drawing Sheets

Fig. 9B
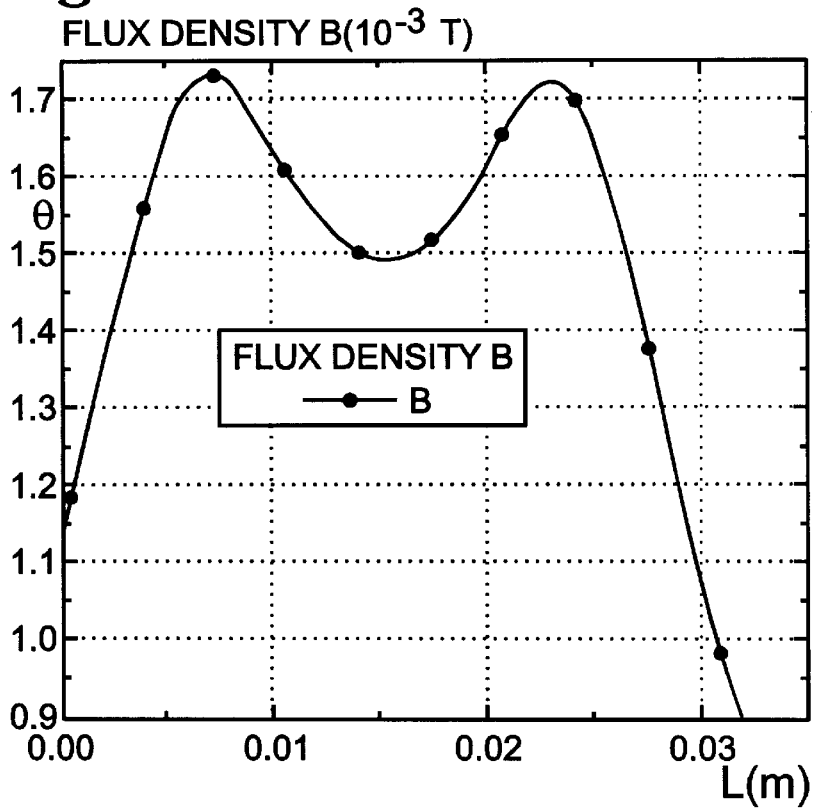
Fig. 9A
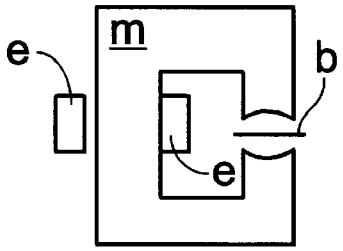
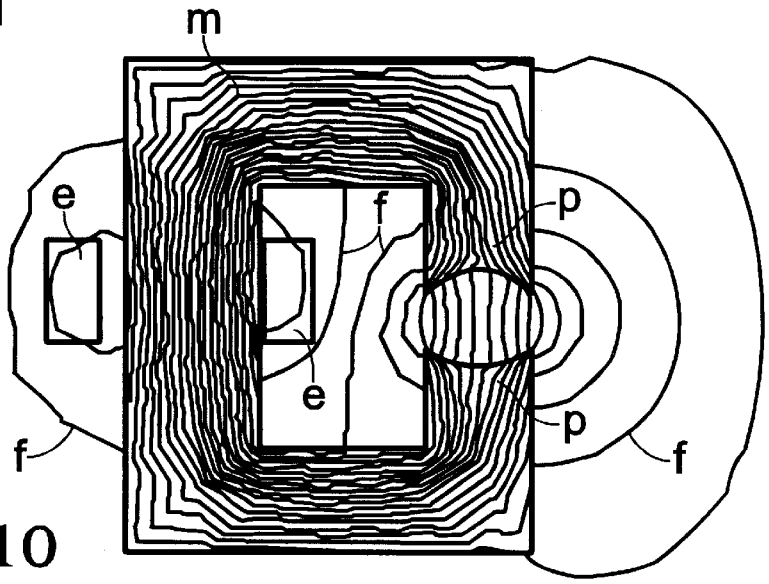
Fig. 10

INDUCTIVELY COUPLED INCANDESCENT LIGHT BULB

BACKGROUND OF THE INVENTION

1. Field of the Invention

This invention relates generally to illumination devices, especially light bulbs, and more particularly to illumination devices in which a filament is made incandescent so as to provide light, and for which a principle design element has been the attainment of a longer useful life.

2. Background Information

Incandescent light bulbs can become non-functional, or "burn out," as a result of breakage or other loss of structural integrity. Such bulbs include metallic filaments that become broken, or there may occur a rupture in the hermetic seal by which the lead-in conductors that provide power to the device are passed into the interior of the bulb. Typically, such breakage or loss of integrity results from simple evaporation of the filament material and a resultant loss of mechanical strength. Breakage may also result from heat stress, both from heat cycling in being turned on and off, and from temperature gradients established at the juncture of various internal structures with the glass or glass-like envelope that surrounds those internal parts and provides the support required to hold those parts in position.

To counteract such filament evaporation, such bulbs may include, along with a filling of inert gas such as argon, a small amount of halogen or compounds thereof, the latter acting to re-deposit evaporated filament material back onto the filament at the hottest parts thereof. While this procedure is quite effective in permitting hotter filament temperatures and hence more efficient light emission, a consequence of having the halogen gas present is that filament material is "scavenged" thereby from the colder ends of the filament near to the lead-in conductors and the seal with the surrounding glass envelope, whereby such colder ends similarly may become weak and eventually break.

Another source of bulb failure involves the interface between the glass envelope and the lead-in conductors. For example, U.S. Pat. No. 3,420,944 issued Jan. 7, 1969 to Holcomb describes a lead-in conductor having a thin intermediate foil or ribbon portion made of a refractory metal such as molybdenum at the point of the seal. Such metal is subject to oxidation at its outer end and ultimately to breakage as a result of the infusion of oxygen from the surrounding atmosphere into the seal, hence one solution to the problem has been to provide to the foil a coating of an oxidation-resistant material such as chromium. However, such coatings have been found to undergo chemical reaction with the internal halogen atmosphere, hence to avoid that occurrence Holcomb limits the application of the oxidation-resistant material to an outer segment of the foil, the inwardly extending uncoated molybdenum being unaffected by the interior halogen atmosphere.

In addition to chemical attacks on such intermediate ribbon portions, as was previously noted active halogens such as bromine also cause corrosion of the filament coils themselves near the ends of the filament, as a result of sharp temperature gradients both between adjacent coils of the filament and between the filament and a connecting spud that attaches the filament to the lead-in connectors. In U.S. Pat. No. 3,431,448 issued Mar. 4, 1969 to English, that effect is sought to be minimized or eliminated through use of a structural design wherein sharp temperature gradients are reduced. U.S. Pat. No. 4,568,854 issued Feb. 4, 1986 to Westlund et al., uses a particular ceramic base for improved heat dissipation in a type of high temperature tungsten halogen lamp.

Yet another cause of filament breakage lies in a "sagging" effect whereby an initially horizontally disposed filament having the usual coiled structure will become elongated upon being incandesced, the center portion thereof will sag downwardly from the effect of gravity, and the resulting curvature in the filament may ultimately bring adjacent turns of the coils thereof into contact so as to short out, or contact may similarly be made between a coil and a mounting structure. Even in the absence of such breakage, such sagging serves to move downwardly the central source of light from the bulb, thereby requiring adjustment in the position of the bulb when it is used as a light source in a focused system of lenses. As described in U.S. Pat. No. 3,789,255 issued Jan. 29, 1974 to Sell et al., inclusion within the filament material of dopants in the form of alkali silicates, or in the Sell et al. patent itself of means for producing helium-filled bubbles within the filament, will result upon incandescence of the filament in the growth of elongated and interlocked grains or crystals that are axially disposed and serve to minimize sagging.

U.S. Pat. No. 4,451,760 issued May 29, 1984 to Griffin et al. addresses the issues of filament sag and halogen corrosion through the introduction into the envelope of a quantity of copper, e.g., as one of the lead-in wires, a plating on the lead-in wires, a separate copper insert, or a coating on the filament. One source of filament sag is understood to lie in grain boundary slippage within the filament material, particularly in halogen lamps that will have present some amount of gaseous oxygen, since such slippage is thought to be facilitated by free oxygen. That oxygen is also thought to exacerbate metal corrosion by the halogen gas. The copper serves to remove oxygen and thereby minimize both grain boundary slippage and corrosion.

In U.S. Pat. No. 4,449,398 issued Feb. 12, 1985 to Munroe, an elongate incandescent bulb is described that has relatively massive terminals at each end thereof, and one or more elongate helical coils, supported on a stiff refractory central element, extending therebetween. This structure permits use of filament coils of a size larger than is customary and is thus less susceptible to breakage.

As opposed to such direct energy input to a filament, fluorescent bulbs of the type described in U.S. Pat. No. 3,987,335 issued Oct. 19, 1976 to Anderson operate not by means of a heated filament but rather by the fluorescence of a phosphor that has been excited by radiation from a contained, ionized gas. As described by Anderson, previous efforts to provide excitation of the contained gas so as to produce that ionization have included coupling electrical energy thereinto by means either of ordinary induction using an electrical air transformer or by electromagnetic induction, i.e., an rf energy source, but such efforts have proved to be too inefficient and also become sources of possibly dangerous rf radiation. It is also known to use rf fields for the purpose of "flashing" a "getter," i.e., a piece of magnesium or the like within the bulb is brought to incandescence by an rf field so as to react with residual gases left within an evacuated bulb and thereby effectively remove the same.

Efforts based upon the use of iron or ferromagnetic transformer cores have likewise proved to be too inefficient, i.e., at the frequencies required for useful energy transfer to the gas the eddy current heating losses occurring in such cores become too great, resulting not only in a loss of energy but also in creating unacceptable heat levels within the bulb. The Anderson patent describes a device in which ionization in the gas is induced by a transformer that is only partially contained within the bulb envelope, the portion of the transformer that is open to the atmosphere serving as a means for cooling of the transformer as a whole.

Lamps that provide fluorescence energy by means of a spark discharge within a gas are described in U.S. Pat. No. 4,187,446 issued Feb. 5, 1980 to Gross et al. and in U.S. Pat. No. 4,311,942 issued Jan. 19, 1982 to Skeist et al. Both such patents employ ballast designs that employ diverging magnetic fields which serve to expand the arc volume for increased gas excitation while also limiting the arc current. U.S. Patent No. 4,855,635 issued Aug. 8, 1989 to Grossman et al., describes the use of permanent magnets in manipulating the arc shape.

From the foregoing, it is apparent that heating of a filament to incandescence by direct electrical connection to an external current source must necessarily involve numerous technical problems arising principally from the presence of heat gradients in passing from inside to outside of the bulb envelope and within the filament itself. Sagging of that filament introduces another cause of breakage. Fluorescent bulbs avoid such filament problems, and moreover provide light with substantially greater efficiency than do incandescent bulbs. However, the fluorescent bulb introduces its own inefficiencies, commencing with the need to achieve a transformation of electrical energy from a conducting environment to a gas; secondly, ionization of that gas; thirdly, ionic de-excitation to provide radiation; fourthly, application of that radiation to the excitation of a phosphor; and finally, emission of light from that phosphor. In particular, the process of exciting the gas by means either of inductive coupling or an arc discharge must be inherently inefficient, given the volume-extended and spaced-apart nature of any gas relative to any particular means for exciting the same. Such inefficiency is exacerbated by the fact that energy absorption by a gas is at least quasi-quantized in nature, and the relatively crude, macroscopic methods of inductive or arc excitation cannot take account of the most efficient energy absorption profile of the gas as defined, e.g., by its frequency-dependent Einstein absorption coefficient. Such processes may be improved by the use of appropriate magnetic fields to control and shape the excitation process, but yet it remains as a substantial barrier to the efficient production of light. What is needed and would be useful, therefore, is a method and apparatus by which a filament within an evacuated envelope could be brought to incandescence while avoiding the problems of heat gradients inherent in the use of lead-in conductors. It would also be useful if means could be provided by which sagging of the filament could be avoided. No such method and apparatus being otherwise available, they are now provided by the present invention.

SUMMARY OF THE INVENTION

The invention comprises a method and apparatus for energizing a filament within an evacuated bulb to a state of incandescence without the need for electrical connectors to pass through that envelope. Specifically, the filament is energized inductively, i.e., it is fabricated and disposed so as to lie within a high intensity region of an externally applied magnetic field, and thereby to have electric currents induced therein that are sufficient to heat the filament material to incandescence. Unlike the case of an extended gas, the filament can be of a small and precisely definable shape for more efficient interaction with an external field. Moreover, energy absorption by inductive coupling to a conductor is not a quasi-quantized process, but is instead of the same macroscopic nature as is the production of the magnetic field. By appropriate shaping of the applied magnetic field relative to the filament geometry, therefore, the bulb efficiency (i.e., the ratio of the light energy produced to the electrical energy applied) can be optimized while at the same time avoiding many of the principal causes of failure in present incandescent bulbs.

Also, since a non-uniform alternating magnetic field will apply a force to a conducting body placed therein, the applied field may be adjusted in terms of uniformity as well as shape, thereby to impart sufficient lift to the filament to counteract the effect of gravity, i.e., the problem of breakage through filament sagging is essentially eliminated. Indeed, as a practical matter it would be difficult to establish a magnetic field that was so uniform that one could energize the same without introducing at least some "lift," i.e., without some movement of a central filament. The functions of filament energization and movement are thus inherently entwined. Since the shape and intensity of the magnetic field depends upon the current levels imposed upon some selected array of "primary" coils, the precise nature of that lifting effect can then be controlled electronically. Furthermore, the specific location of the filament within the envelope can similarly be adjusted, e.g., for light focusing purposes.

The kinds of embodiments in which the aforesaid method and apparatus may be realized include at least (1) a toroidal filament disposed within the circumference of a similarly toroidal envelope and having a magnetic core passing through the center of the toroid; and (2) a loop filament entirely disposed within an encircling envelope and having an external magnetic field passing transversely through the plane of the filament loop.

BRIEF DESCRIPTION OF THE DRAWINGS

The preferred embodiments of the invention will now be described in detail with reference to the accompanying drawings, in which:

FIG. 9A illustrates an electromagnet adapted for excitation of a filament in accordance with the invention.

FIG. 9B shows a graph of flux density vs. distance along the line b of FIG. 9A.

FIG. 10 shows the magnetic field lines, as calculated by finite element analysis, that are produced upon excitation of the electromagnet of FIG. 9A,.

DETAILEID DESCRIPTION OF THE INVENTION

Figure 1:
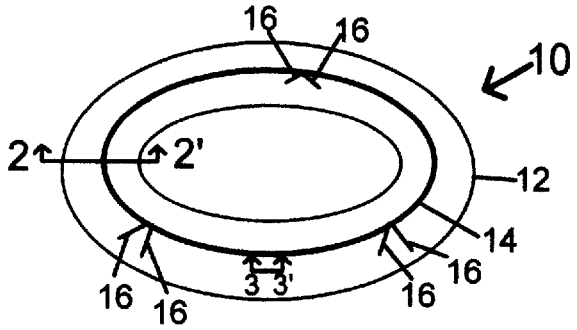
FIG. 1 is a perspective drawing of a toroidal embodiment of the invention.
Figure 2:
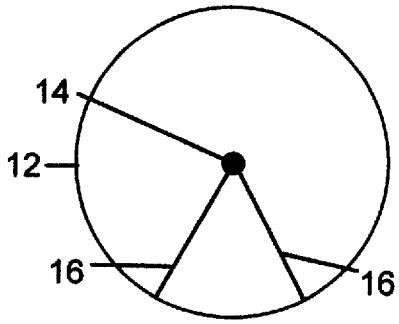
FIG. 2 is a cross-sectional view of the toroidal bulb of FIG. 1, taken through the lines 2—2' of FIG. 1.
Figure 3:
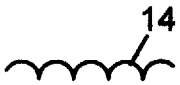
FIG. 3 is an enlarged segment of the filament of FIGS. 1 and 2 showing the coiled structure thereof, taken at the insert 3—3' of FIG. 1.

FIG. 1 shows a toroidal bulb 10, which principally includes a toroidal envelope 12 formed of transparent glass, quartz, or a similar material, and which contains therein a filament 14 that is disposed in a circular shape that is concentric with the toroidal structure of envelope 12, i.e., centrally located within the cross-section thereof. Filament 14 is held in position by braces 16, of which just a few are shown in FIG. 1 for reasons of clarity, and which are also shown in the cross-sectional view of FIG. 2 wherein the reference labels 12, 14, and 16 have the same meanings as in FIG. 1. Braces 16, which may be of ceramic or similar material of low heat conductivity, are employed at sufficient points around the circumference of filament 14 to hold the same at a central position within the cross-section of envelope 12 without undue sagging. While not discernible in FIGS. 1 and 2, the short segment of filament 14 depicted in FIG. 3 shows that, other than being formed into a circular shape in the present invention, filament 14 preferably has a conventional coiled structure. Because of the manner in which filament 14 is heated, i.e., by inducing therein a high electrical current by magnetic induction, no external electrical connections to filament 14 are required. While not being shown in any of the figures, toroidal bulb 10 will as usual include a filling of gas, e.g., a major inert gas constituent and a minor halogen gas constituent as described, for example, in U.S. Pat. No. 5,359,262 issued Oct. 25, 1994 to Bell et al.

Figure 4:
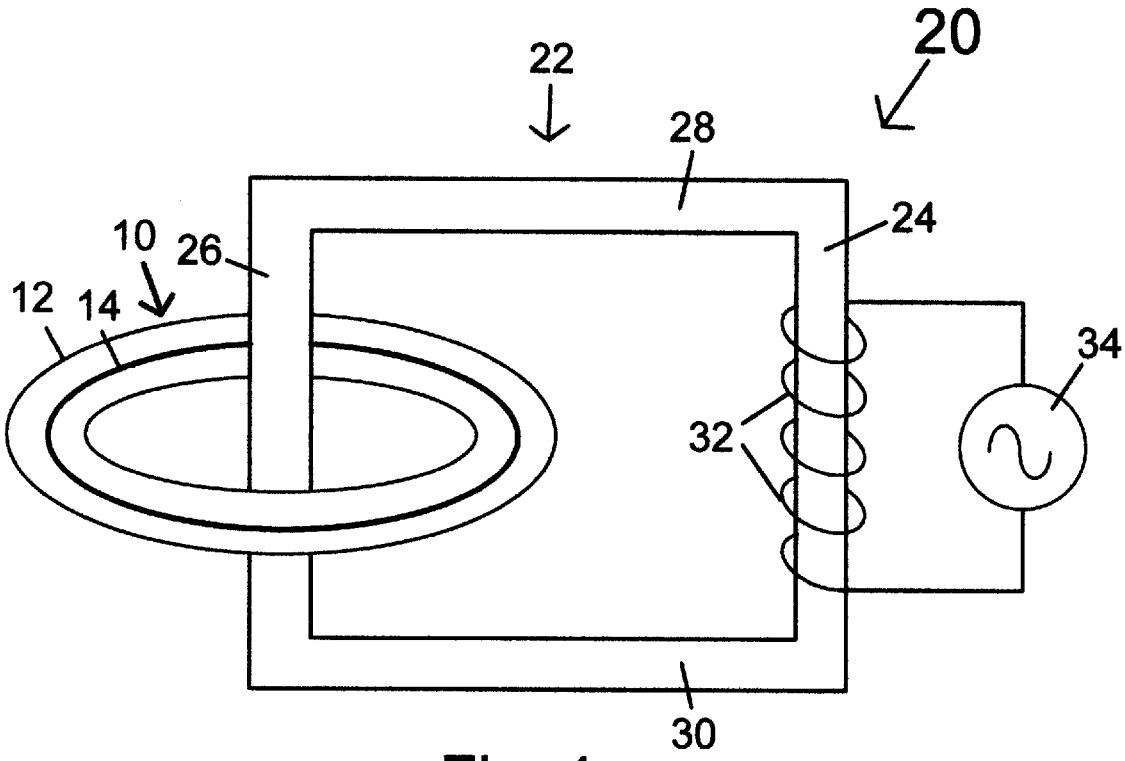
FIG. 4 shows one method of applying a magnetic field to the toroidal bulb of FIG. 1.

One embodiment of the invention that utilizes toroidal bulb 10 is shown in FIG. 4, comprising first incandescent bulb 20 in which toroidal bulb 10 having envelope 12 and filament 14 are again shown (for purposes of clarity, braces 16 are not shown). FIG. 4 also shows a magnetic core 22 including a primary side 24, a secondary side 26, an upper arm 28 that interconnects primary side 24 and secondary side 26 at first ends thereof, and a lower arm 30 that interconnects primary side 24 and secondary side 26 at second ends thereof opposite said first ends, all of which are formed of a high permeability material such as iron alloy so as to provide a magnetic circuit. Secondary arm 26 is disposed so as to pass orthogonally through the plane of toroidal bulb 10 and at the center thereof. Coils 32 that connect at opposite ends thereof to an excitation source 34 are disposed around a substantial length of primary side 24 so that application of an alternating current to coils 32 produces an alternating magnetic field that may be confined essentially within magnetic core 22. The relative disposition of secondary side 26 and toroidal bulb 10 is such as to induce from that alternating magnetic field a strong electrical current in filament 14 and thus to heat the same to a state of incandescence.

Figure 5:
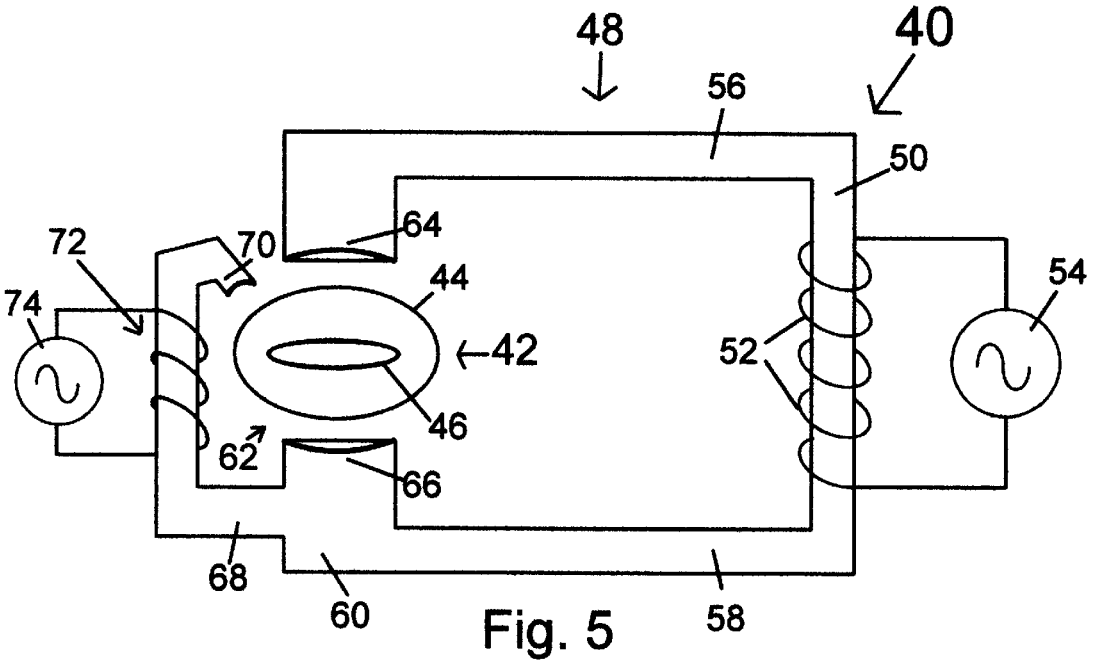
FIG. 5 shows an elliptical embodiment of the invention that is adapted to provide an anti-sagging lift to the enclosed filament.

FIG. 5 shows in second incandescent bulb 40 an alternative embodiment of the invention, comprising an elliptical bulb 42 having an elliptical envelope 44 that is evacuated and gas-filled as before, and also an elliptical filament 46. The term "elliptical" is intended to include circular structures in each case, the precise eccentricity of which is adapted so as to optimize the coupling of filament 46 to an externally applied magnetic field, the shape of the latter being established by the physical shape of the magnetic pole pieces facing filament 46.

In this embodiment, a magnetic core 48, which is formed of a high permeability material such as iron alloy as before, has a primary side 50, along the length of which are disposed coils 52 that in turn are connected across excitation source 54; top and bottom arms 56, 58 having proximate ends that are respectively contiguous to opposite ends of primary side 50; and a secondary side 60 that is contiguous at respective opposite exterior ends thereof to the distal ends of top and bottom arms 56, 58. Secondary side 60 includes near its middle a gap 62 within which is placed elliptical bulb 42. Upper and lower gap faces 64, 66, which are cusp-shaped for purposes of defining the shape of a magnetic field therebetween, comprise inwardly-facing ends of secondary side 60 that face oppositely across gap 62 so as to pass a magnetic field therebetween. Elliptical bulb 42 is disposed within gap 62 so as to maximize the coupling between filament 46 and a magnetic field passing through gap 62.

Magnetic core 48 further comprises a "tuning" side 68 that first extends outwardly (leftward in FIG. 5) from secondary side 60; then upwardly (i.e., in parallel with secondary side 60) past gap 62; and then rightwardly and downwardly so that distal gap face 70 at the terminus of tuning side 68 faces generally in the direction of lower gap face 66. Tuning coils 72 are disposed along that portion of tuning side 68 that lies in parallel with secondary side 60, said tuning coils 72 being connected across a source of tuning excitation 74. Tuning side 68 and a lower porton of secondary side 60 thus provide a magnetic circuit which confines a magnetic field produced by tuning coils 72 so as to pass essentially between terminal gap face 70 and lower gap face 66.

Figure 6:
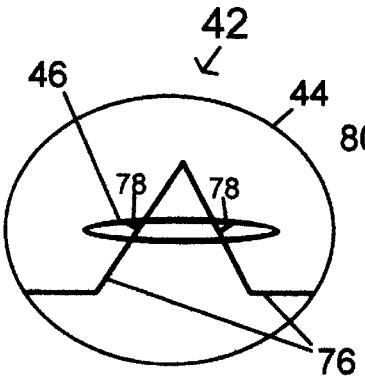
FIG. 6 shows in a larger scale the elliptical bulb of FIG. 5, illustrating the manner of holding the filament thereof within the bulb.

FIG. 6 shows elliptical bulb 42 of FIG. 5 in a larger scale, illustrating the manner of holding filament 46 therein. Specifically, conical support 76 is attached to envelope 44 of elliptical bulb 42, and connected to conical support 76 are a number of struts 78 (for clarity, only two such struts are shown in FIG. 6) to which filament 46 is connected at a sufficient number of points to support the same.

Figure 7:
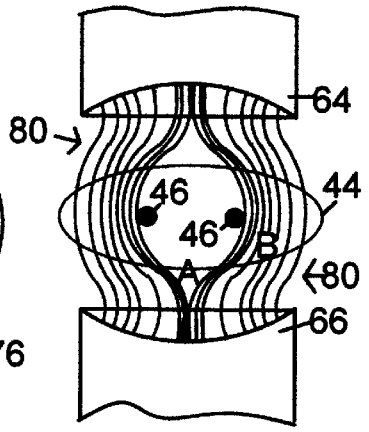
FIG. 7 illustrates in cross-section the principle by which an elliptically-shaped magnetic field may be formed so as to provide optimum coupling to an elliptical filament disposed therein.

FIG. 7, wherein reference numeral 44 again refers to the bulb envelope, illustrates in cross-section the principle by which an elliptically-shaped magnetic field may be formed so as to provide optimum coupling to an elliptical filament disposed therein. The elliptical (which again includes circular) shape of that field is accomplished by the use of cusp-shaped (i.e., concave) upper and lower gap faces 64, 66 so as to produce a magnetic field that can be described by lines such as first field lines 80 shown in FIG. 7. (For purposes of simplicity in the illustration, the minor distortion to the magnetic field that is necessarily caused by the presence of tuning side 68 on just one side of secondary side 60 will not be shown.)

The shapes of first lines 80 are not intended to be precise in FIG. 7, but merely to illustrate the principle that by defining the shapes of upper and lower gap faces 64, 66 to be concave, a magnetic field will be produced therebetween that will exhibit a divergence of lines at the central region of each face, i.e., at region A shown in FIG. 7, and outwardly therefrom a region B of converging and more densely packed lines. Region B is established within a full circle or ellipse lying between upper and lower gap faces 64, 66 so as to coincide with the location of filament 46 and thus to provide maximum coupling of magnetic field thereto. The efficiency of heating filament 46 by the applied magnetic field derived from excitation source 54 is thus optimized.

Figure 8:
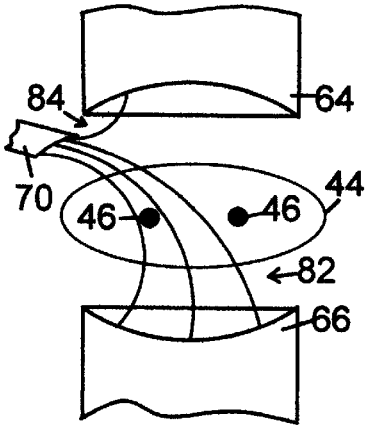
FIG. 8 illustrates in cross-section the principle by which a non-uniform alternating magnetic field may be applied to a filament to adjust the lift thereof.

The manner of providing lift to filament 46 so as to counteract the effect of gravity is shown in FIG. 8, which illustrates the creation of second field lines 82 by application to tuning coils 72 of tuning excitation 74 (not shown herein) and wherein reference numeral 44 again refers to the bulb envelope. Because of the smaller size of terminal gap face

70 relative to lower gap face 66, second field lines 82 that extend therebetween will be more concentrated near terminal gap face 70 than near lower gap face 66, thus to produce a stronger magnetic field near terminal gap face 70 (which lies above filament 46) than near lower gap face 66 (which lies below filament 46), thereby to produce lift. As is also shown in FIG. 8, some minimal amount of third field lines 84 will extend between terminal gap face 70 and upper gap face 64 in view of the near physical proximity of those two elements, but that effect is minimized by precise definition of the shapes of terminal gap face 70 and upper and lower gap faces 64,66. The same will be the case with respect to the disposition of second field lines 82 across the full plane of filament 46, i.e., the second field lines 82 as shown in FIG. 8 would appear to be more concentrated leftwardly in the Figure than rightwardly; however, second field lines 82 as shown are again not intended to be precise, and the optimum distribution thereof is again accomplished by rigorous design of terminal gap face 70 and upper and lower gap faces 64,66. Mathematical procedures that will accomplish such design, such as perturbation theory, finite element analysis or the like, are well known and can be applied routinely to the design of both first and second incandescent bulbs 20, 40, commencing with the selection of initial radii for filaments 14 or 46, respectively (e.g., 0.5 inch diameter) and then the additional design necessary to optimize the heating thereof as previously described.

To illustrate such design processes, an electromagnet m having an excitation coil e surrounding one arm thereof is shown in FIG. 9A. FIG. 9B shows a graph of the flux density B as calculated by finite element analysis taken along the line b of FIG. 9A. In this particular instance, FIGS. 9A and 9B were derived using the program Students' Quickfield (TM) of Tera Analysis (Tera Analysis Co., P.O. Box 571086, Tarzana, Calif. 91357; down-loadable from the internet at http://www2.tera-analysis.com/tera/), but more advanced versions of this or similar programs may be used for more precise magnet design. (The parameter "L(m)" in FIG. 9B, as introduced by the aforesaid program, corresponds to the parameter "b" of FIG. 9A.) The flux density B between the pole faces in FIG. 9A can be seen in FIG. 9B to have two maxima nearly symmetrically disposed about a small central saddle and much lower values away from the pole faces. FIG. 10, wherein the reference letters e and m have the same significance as in FIG. 9A, shows the magnetic field lines f as calculated and drawn by that same program, again using the magnet of FIG. 9A. In particular, FIG. 10 shows more precisely and quantitatively than does FIG. 7 the nature of the magnetic field produced between concave pole faces p as shown in FIG. 10 (corresponding to upper and lower gap faces 64,66 of FIG. 7). A similar design process may be applied to the magnet of FIG. 5.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof.

I claim:

1. An incandescent bulb comprising:

an evacuated bulb;

a gas filling within said evacuated bulb;

a filament in the form of an ellipse lying in a filament plane; holding means for holding said filament; and magnetic means for inducing an electrical current within said filament and heating said filament to incandescence.

2. The bulb of claim 1 wherein said evacuated bulb is toroidal in shape; and said filament is centrally disposed within a cross-section of said evacuated bulb throughout a circumference thereof.

3. The bulb of claim 2 wherein said magnetic means comprise:

first magnetic means comprising a high permeability magnetic circuit having first and second sides;

first excitation means for applying a varying magnetic field to said first side; wherein said second side passes orthogonally through a plane defining the location of said evacuated bulb and through a center of said evacuated bulb toroid.

4. The bulb of claim 1 wherein said evacuated bulb is elliptical in shape; and said filament comprises a closed loop disposed centrally within said evacuated bulb.

5. The bulb of claim wherein 1 said magnetic means comprise:

a high permeability magnetic circuit having first and second sides and excitation means for applying a varying magnetic field to said first side; and said second side further includes a gap near a midpoint thereof; and said evacuated bulb is located within said gap such that the filament plane lies normally to a longitudinal axis of said second side.

6. The bulb of claim 5 wherein said second side further comprises:

a pair of cusp-shaped faces disposed in a mutually facing relationship across said gap.

7. The bulb of claim 6 wherein said cusp-shaped faces have shapes so as to provide an intensified magnetic field above said filament.

8. The bulb of claim 6 further comprising:

a third magnetic side near to and essentially parallel to said second side;

second excitation means for providing a magnetic field within said third magnetic side; and a terminal gap face that terminates said third magnetic side and is oriented in a direction facing towards one of said cusp-shaped faces.

9. The bulb of claim 8 wherein said terminal gap face has a size that is smaller than a respective size of said cusp-shaped gap faces, whereby a non-uniform magnetic field is provided about said filament.

10. The bulb of claim 9 wherein said terminal gap face has a shape such that said non-uniform magnetic field will have nearly the same field strength about a circumference of said filament.

11. A method for producing light from an evacuated bulb comprising:

providing a loop filament disposed within an evacuated bulb; inducing an electrical current within said filament using a magnetic circuit responsive to a first magnetic field to excite a primary side of said magnetic circuit; and heating said loop filament to incandescence with said electrical current.

12. The method of claim 11 further comprising:

providing said evacuated bulb that is toroidal in shape;

disposing said filament within a circumference of said evacuated bulb; and providing a second magnetic field by passing a secondary side of said magnetic circuit orthogonally through a center of said evacuated bulb.

13. The method of claim 11 further comprising:

providing said evacuated bulb that is toroidal in shape;

disposing said filament centrally within said evacuated bulb; and providing a second magnetic field by locating said evacuated bulb within a gap between oppositely facing faces of a secondary side of said magnetic circuit.

14. A method of providing lift to a filament disposed within an evacuated bulb comprising:

providing an upper magnetic face disposed above said evacuated bulb;

providing a lower magnetic face disposed below said evacuated bulb, said lower magnetic face having a larger cross-sectional area than a cross-sectional area of said upper magnetic face;

providing a magnetic field passing between said upper and lower magnetic faces, said magnetic field being more intense near to said upper magnetic face than near to said lower magnetic face; and deriving from said magnetic field a net upward force acting on said filament thereby providing the lift to the filament.

* * * * *